United States Patent [19]

Keske

[11] 4,246,810

[45] Jan. 27, 1981

[54] TOOL FOR PRE-TENSIONING A FASTENER

[75] Inventor: Frank E. Keske, Chillicothe, Ill.

[73] Assignee: Caterpillar Tractor Co., Peoria, Ill.

[21] Appl. No.: 89,112

[22] PCT Filed: May 10, 1979

[86] PCT No.: PCT/US79/00312

§ 371 Date: May 10, 1979

§ 102(e) Date: May 10, 1979

[51] Int. Cl.[3] ..... B25B 29/02

[52] U.S. Cl. ..... 81/57.38

[58] Field of Search ..... 81/57.38

[56] References Cited

U.S. PATENT DOCUMENTS

| | | | |
|---|---|---|---|
| 4,020,720 | 5/1977 | Fujii | 81/57.38 |
| 4,104,934 | 8/1978 | Raschke et al. | 81/57.38 |

*Primary Examiner*—James L. Jones, Jr.

*Attorney, Agent, or Firm*—Phillips, Moore, Weissenberger, Lempio & Majestic

[57] ABSTRACT

Bolts (11) are used to assemble a cylinder head and an engine block. The bolts (11) must be torqued to a preload tension. The tension often decays or relaxes after a time, thus reducing the firm fastening which is desired. A fastening tool (10,10a) of this invention provides for the efficient and closely controlled imposition of a predetermined tension on a stud (13) while simultaneously applying a torque to a nut (15) to rotate and tighten it to maintain such tension. The fastening tool (10,10a) comprises a housing (18,18a) having a fluid-actuated piston (24,24a) reciprocally mounted therein. The piston (24,24a) is adapted for threaded attachment with the stud (13) to imposed a predetermined tension thereon.

1 Claim, 4 Drawing Figures

FIGURE 2
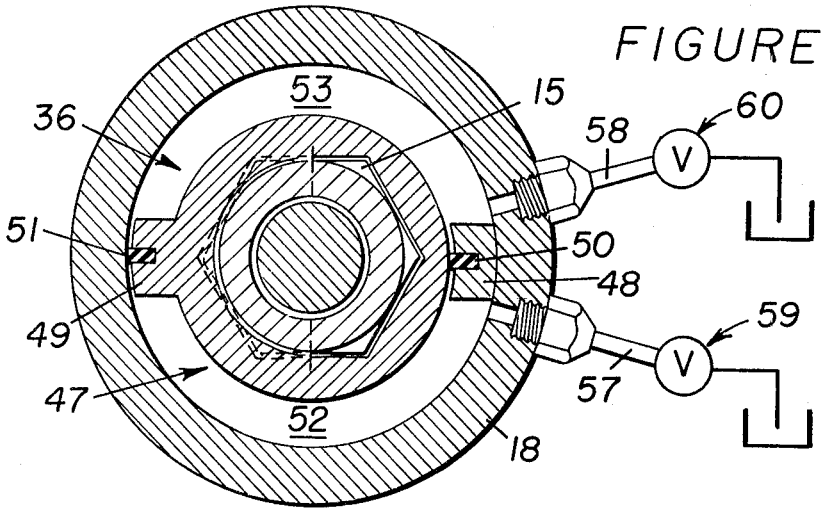
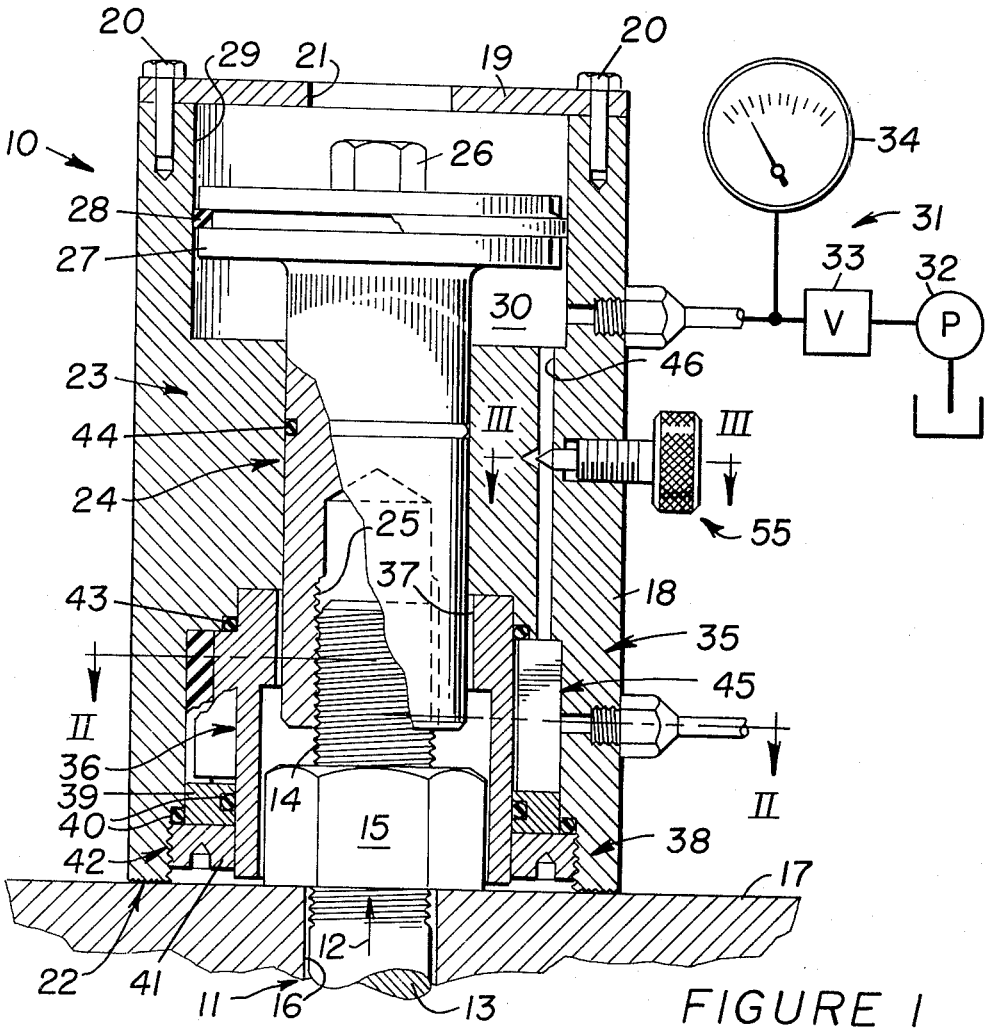
FIGURE 1

TOOL FOR PRE-TENSIONING A FASTENER

TECHNICAL FIELD

This invention relates to a fastening tool for tensioning a fastener, such as a stud having a nut threadably mounted thereon.

BACKGROUND ART

The assembly of a cylinder head and an engine block is normally accomplished by utilizing fasteners, such as bolts or studs having nuts threadably mounted thereon. The fasteners must be preloaded under a predetermined tension to firmly secure the head on the block and to avoid sealing problems in the area of the gasket which is clamped between the head and the block. The preload imposed on the fasteners must also take into consideration any subsequent relaxation or decay of such tension.

A common practice is to employ a torque wrench for preloading the fasteners. One problem occasioned with the use of a torque wrench is that the gauge thereof may not provide accurate readings due to errors induced by factors such as friction at the threads of the driven nut. Even assuming that the preloading procedure is accomplished with good operator control, the tension of the fastener may vary as much as ±30%. Although the preload initially imposed on the fasteners by the torque wrench may exhibit substantial error, the subsequent decay of the preload over a prolonged period of service time is normally within acceptable limits, such as ±10%.

Another common practice is to preload fasteners of the stud and nut type by first pre-tensioning the stud and then by turning-down the nut by hand or with a driver. Although initial preloading is more accurate than is achieved by use of a torque wrench, the subsequent relaxation or decay of the preload over an extended period of service time may be as high as 50%. This loss in preload primarily occurs because the engaging threads are loaded for the first time when the pre-tensioning load is relieved to thus transfer the load onto the threads of the nut and they are loaded to a stress level beyond their yield point. In addition, burrs and corners of the engaging screw threads are loaded for the first time to further induce creep due to localized high stresses.

DISCLOSURE OF INVENTION

In one aspect of the present invention, the problems pertaining to the known prior art, as set forth above, are advantageously avoided.

The above is accomplished by providing a tool for pretensioning a fastener comprising tensioning means for detachably engaging an end of a stud and for imposing a predetermined tension thereon, rotating means for detachably engaging and rotating a nut threadably mounted on the stud to at least substantially retain the predetermined tension, and common fluid control means for simultaneously tensioning the stud and rotating the nut.

The fastening tool of this invention provides for the closely controlled tensioning and torquing of a fastener to apply a predetermined preload thereto which will exhibit minimal decay over an extended period of service time.

BRIEF DESCRIPTION OF THE DRAWINGS

Other objects of this invention will become apparent from the following description and accompanying drawings wherein:

FIG. 1 is a sectional view in elevation illustrating a first fastening tool embodiment of the present invention shown engaged with a fastener;

FIG. 2 is a cross-sectional view through the fastening tool, taken in the direction of arrows II—II in FIG. 1;

BEST MODE OF CARRYING OUT THE INVENTION

Figure 3:
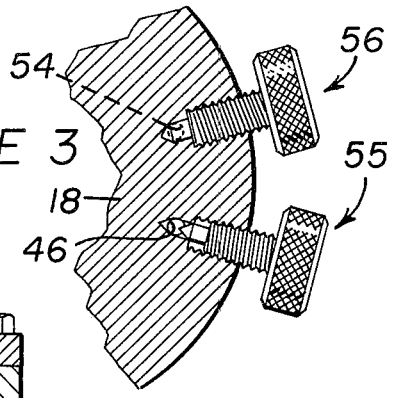
FIG. 3 is a partial sectional view, taken in the direction of arrows III—III in FIG. 1.

FIGS. 1 and 2 illustrate a fastening tool 10 which is adapted to preload a fastener 11 under a tension 12 and substantially simultaneously apply a torque thereto to retain such tension. In the application illustrated, fastener 11 includes a stud 13 having a threaded end 14 and a hex nut 15 threadably mounted on the stud. Stud 13 projects downwardly through a hole 16 formed in a member 17 which may constitute the cylinder head of an internal combustion engine. The lower end of stud 13 would be, of course, suitably secured to the block of the engine, such as by screw threads.

Although fastening tool 10 finds particular application to the pre-tensioning and torquing of fasteners 11 for the purpose of securing cylinder head 17 to the block of an engine, it should be understood by those skilled in the arts relating thereto that fastening tool 10 will find many other applications wherein the closely controlled tensioning and torquing of a fastener proves desirable.

Fastening tool 10 comprises a tubular housing 18 having a plate 19 secured on an upper end thereof by cap screws 20. A hole 21 is formed centrally through plate 19 for purposes hereinafter explained. The lower end of housing 18 may be roughened at 22, such as by knurling, to stabilize fastening tool 10 against the upper surface of head 17 of the engine during the hereinafter described tensioning and torquing operations and to allow escape of any hydraulic fluid which might collect between the housing and head to affect the desired frictional engagement therebetween.

A tensioning means 23 is disposed in housing 18 for detachably engaging threads 14 of stud 13 and for imposing a predetermined tension thereon. Tensioning means 23 comprises a piston 24 having threads 25 formed internally on one end thereof to threadably engage threads 14 of stud 13. A hex head 26 is welded or otherwise suitably secured to a second, opposite end of piston 24 to receive a socket thereon, through aligned hole 21 of plate 19, to rotate piston 24 into threaded engagement with stud 13.

Pistion 24 further comprises an annular head 27 having a ring seal 28 suitably mounted thereon and reciprocally mounted within a cylindrical chamber 29, defined in housing 18. An actuating chamber 30, forming part of a control means 31, is defined between housing 18 and the underside of piston head 28, for selectively receiving pressurized fluid (preferably hydraulic) therein to exert an upward force on piston 24 whereby stud 13 will be stretched to impose a predetermined tension thereon. Control means 31 further comprises a standard positive displacement pump 32, a control valve 33, and a pressure gauge 34 for permitting the operator to closely control the fluid pressure in chamber 30 and thus the tensile force applied to stud 13.

Fastening tool 10 further comprises rotating means 35 for detachably engaging and rotating nut 15, simultaneously with the stretching of stud 13 by tensioning means 23, to at least substantially retain the predetermined tension 12 imposed on the stud upon turning-down of nut 15 against the upper surface of head 17. The final turning-down of the nut will, of course, increase tension 12.

Rotating means 35 comprises a hex socket or socket means 36 adapted to detachably engage hex nut 15, as shown in FIGS. 1 and 2. A bore 37 is formed centrally through an upper end of socket 36 to receive a lower end of piston 24 therein to permit the socket to rotate relative to the piston. A seal retainer 38 may comprise an annular first part 39 having a pair of O-ring seals 40 suitably mounted on either side thereof and an annular second part 41 threadably mounted internally on the lower end of housing 18 at screw threads 42. Additional O-ring seals 43 and 44 may be mounted between the upper end of socket 36 and housing 18, and piston 24 and housing 18, respectively, as shown in FIG. 1.

Rotating means 35 further includes fluid motor means 45 for receiving pressurized fluid from actuating chamber 30, via a first passage 46 defined in housing 18, to selectively rotate socket 36. Fluid motor means 45 comprises an hydraulic motor 47 which includes a stationary vane 48 secured internally on housing 18 and a normally diametrically opposed rotary vane 49 secured on the periphery of socket 36. Elastomeric seals 50 and 51 are suitably secured on vanes 48 and 49, respectively, to thus define a pair of sealed and isolated first and second actuating chambers 52 and 53, respectively, between the vanes, housing 18, and socket 36.

First passage 46 communicates actuating chamber 30 with chamber 52 whereas a second passage 54 (FIG. 3), also defined in housing 18, communicates chamber 30 with chamber 53. Standard valves 55 and 56 are mounted on housing 18 to selectively open or close passages 46 and 54, respectively. If so desired, standard pressure regulating valves could be substituted in lieu of valves 55 and 56 to selectively vary the ratio of fluid pressures in actuating chamber 30 and in chambers 52 and 53 whereby the stretching force imposed on stud 13 and the turning force imposed on nut 15 could be selectively varied to achieve a desired ratio therebetween. As further shown in FIG. 2, a pair of bleed-off lines 57 and 58, having on-off gate valves 59 and 60 therein, communicate with chambers 52 and 53, respectively.

It can thus be seen that pressurization of chamber 52, assuming that valves 55 and 60 are opened and valves 56 and 59 are closed, will rotate socket 36 clockwise in FIG. 2 to apply tightening torque to nut 15 while simultaneously stretching stud 13 in response to pressurization of actuating chamber 30. Any irregularities or burrs in the interengaging threads of nut 15 and threads 14 of stud 13, as well as between the underside of nut 15 and the opposed upper surface of head 17, will be smeared away. Nut 15 will be turned-down a predetermined amount against head 17 to thus at least substantially retain the predetermined tension 12 which has been imposed on stud 13 by tensioning means 23. Turning-down of the nut will normally increase tension 12 a small amount. Removal of nut 15 will, of course, be accomplished by a reversal of the above procedure.

Figure 4:
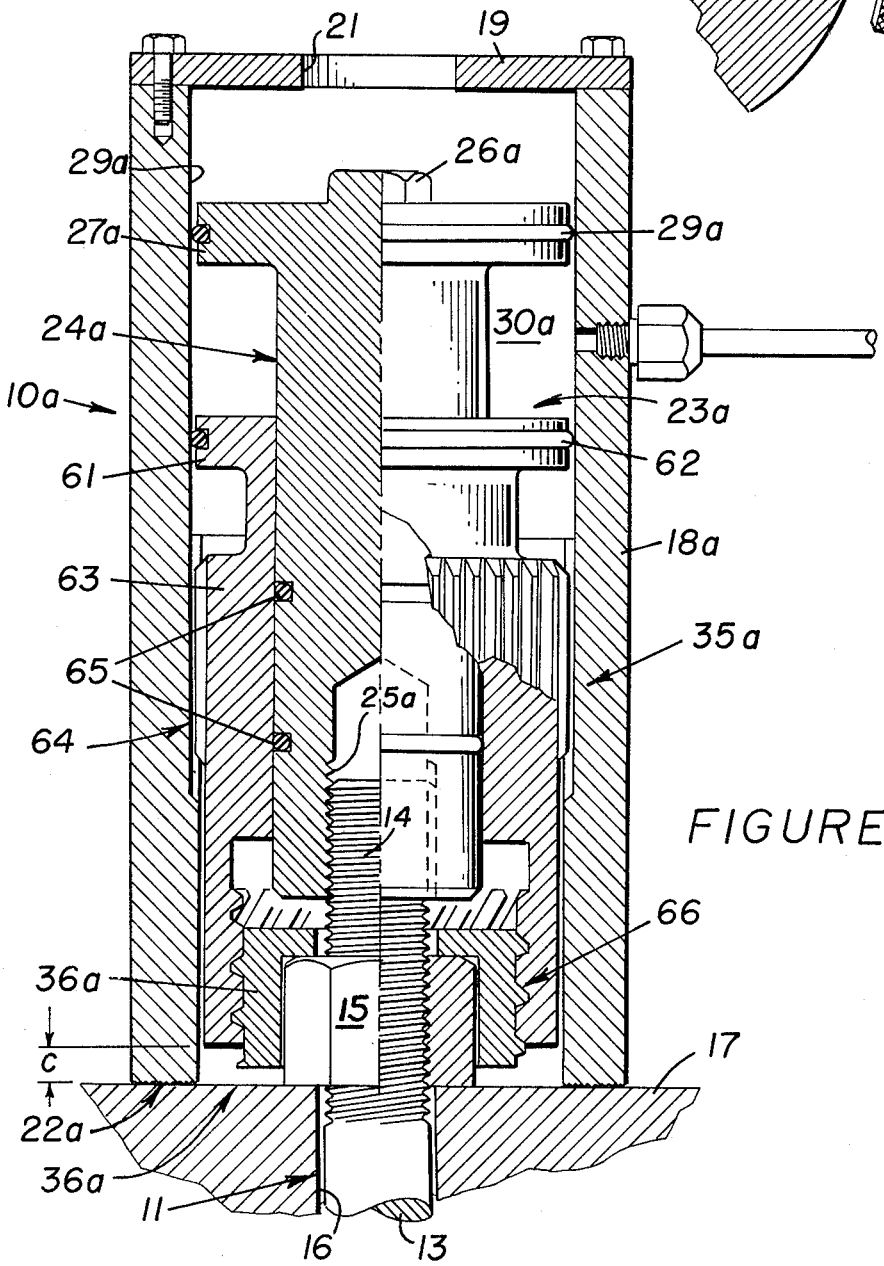
FIG. 4 is a sectional view in elevation, similar to FIG. 1, but illustrating a second fastening tool embodiment of this present invention.

FIG. 4 illustrates a fastening tool embodiment **10*a* wherein identical numerals depict corresponding constructions, but with modified constructions appearing in FIG. 4 being accompanied by an "a." The primary difference between FIGS. 1–3 fastening tool 10 and fastening tool 10*a* is that the latter fastening tool employs a rotating means 35*a* which rotates nut 15** rather than rotating the nut by fluid pressure.

A tensioning means **23*a* of fastening tool 10*a* comprises a piston 24*a* having a head 27*a* thereof reciprocally mounted in a cylindrical bore 29*a* defined in a housing 18*a*. A hex head 26*a*, secured centrally on piston head 27*a*, is also adapted to receive a hex socket thereon to rotate piston 24*a* to threadably engage threads 25*a* thereof with threads 14 of stud 13**.

Stretching of stud 13 to place it under a predetermined tension is effected by communicating pressurized fluid to an actuating chamber **30*a* of control means 31 (FIG. 1) which is isolated from rotating means 35*a* by an annular head 61 having an O-ring seal 62 mounted on the periphery thereof to internally engage housing 18*a* in sliding, sealing contact therewith. Head 61 is formed on one end of a second piston 63 which is mounted only for limited reciprocal movement in housing 18*a* by a straight spline connection 64. Piston 24*a* is reciprocally mounted in piston 63 and a pair of O-ring seals 65 are mounted on piston 24*a* to prevent leakage of hydraulic fluid from actuating chamber 30*a*** thereby.

A socket member **36*a* is formed to fit on hex nut 15 in driving engagement therewith and is connected to piston 63 at a helical spline connection 66. Thus, it can be seen that when actuating chamber 30*a* is pressurized that first piston 24*a* will move upwardly to stretch stud 13 to impose a predetermined tension thereon while, simultaneously, second piston 63 will move downwardly to rotate nut 15 via helical spline connection 66 and socket 36*a*. A lower end of housing 18*a* is also preferably knurled or otherwise suitably roughened at 22*a* to frictionally engage the top surface of head 17** to prevent any relative rotation between the housing and the head.

INDUSTRIAL APPLICABILITY

Although above-described fastening tools 10 and **10*a* find particular application for the precise securance of cylinder head 17** on an engine block, it should be understood that the fastening tools have a wide variety of other applications wherein it is desired to simultaneously impose a predetermined tension on a first part of a fastener and move a second part thereof to maintain such tension. In addition to the ability of the fastening tools to secure a particular fastener in place, it will be obvious to those skilled in the arts relating thereto that precise and expeditious removal of such fasteners can also be effected by the fastening tools.

Referring to FIGS. 1–3, a method for securing cylinder head 17 on a block (not shown) of an engine by use of tool 10 will now be described. Initially, head 17 is mounted on the block to permit studs 13 to project through bores 16. Hex nuts 15 are then hand-tightened prior to mounting of socket 36 on a respective nut 15, as shown in FIG. 1. Valves 55 and 60 are opened whereas valves 56 and 59 are closed.

Actuating chamber 30 is then pressurized with hydraulic fluid by control means 31 to a predetermined level, as indicated on pressure gauge 34. Fluid pressure in chamber 30 will function to force piston 24 upwardly in FIG. 1 to impose a predetermined stretching force or tension 12 on stud 13. Simultaneously therewith, passage 46 will communicate pressurized fluid from chamber 30 to chamber 52 to rotate socket 36 clockwise in FIG. 2 through one-quarter turn, for example. Thus, rotation of the nut on stud 13 will tend to smear-off any irregularities or burrs on the interengaging screw threads, the underside of nut 15, and the engaged top surface of cylinder head 17, etc. Rotation of the nut will impose an additional stretching force and tension on stud 13, but to a much lesser degree than is imposed on the stud by piston 24.

It should be noted that the predesigned ratio between the stretching load applied to stud 13 by piston 24 and the torque load applied to nut 15 by socket 36 may be closely calculated by taking into consideration design criteria, such as the effective area on the underside of piston head 27 and the effective area of movable vane 49 on the side thereof exposed in chamber 52. As suggested above, such ratio can also be varied by substituting a pressure regulating valve in lieu of valve 55 whereby the fluid pressures in chambers 31 and 52 may be selectively varied to different levels.

It should be further noted that the FIGS. 1–3 fastening tool 10 exhibits a minimal amount of friction therein upon reciprocation of piston 24 and rotation of socket 36 in contrast to a conventional torque wrench, for example. Also, knurled surface 22 of housing 18 will be forced downwardly into firm frictional engagement with the upper side of head 17 since the reactive force in actuating chamber 30 will tend to force housing 18 downwardly in FIG. 1. Furthermore, such knurling will permit any fluid leakage from the tool to seep therethrough whereby the frictional engagement between head 17 and housing 18 is continuously ensured.

The method for loosening fastener 11, once it has been tightened, is a substantial reversal of the above-described steps. In particular, tool 10 is mounted over fastener 11 to engage socket 36 with nut 15 whereafter a socket wrench is attached to hex head 26 to rotate piston 24 into threaded engagement with threads 14 of stud 13. Valves 56 and 59 are now opened and valves 55 and 60 are closed to condition tool 10 for pressurization of actuating chamber 30. Upon pressurization of chamber 30 by control means 31, piston 24 will tend to move upwardly in FIG. 1 and pressurized fluid will simultaneously charge chamber 53 from chamber 30, via passage 54 (FIG. 3), whereby socket 36 will rotate counterclockwise in FIG. 2 to loosen nut 15. Upon depressurization of chambers 31 and 53, fastening tool 10 can be removed from threads 14 of stud 13 to permit the worker to remove nut 15 by hand.

The method for tightening fastener 11 with fastening tool **10*a* of FIG. 4 is substantially identical to the above-described method, except that the torquing force applied to nut 15 to rotate it on stud 13 is applied mechanically through helical spline connection 66 rather than hydraulically. In carrying forth the method of tightening fastener 11, the worker would place socket 36 in engagement with nut 15 and then rotate piston 24*a* into threaded engagement with stud 13 at threads 14 by engaging hex head 26*a* with a standard socket wrench. Chamber 30*a* is then pressurized with hydraulic fluid whereby piston 24*a* will move upwardly to stretch stud 13 under a predetermined tension and piston 63 will move downwardly and be guided in its movement by straight spline connection 64**.

Downward movement of piston 63 will cause rotation of socket **36*a*, through helical spline connection 66, whereby a predetermined torque will be applied to nut 15. As suggested above, torquing of nut 15 will also apply a stretching force to stud 13, but a force of much lower magnitude than the stretching force applied to stud 13 by piston 24*a*. The ratio of the stretching force applied to stud 13 by piston 24*a* to the rotational torque applied to nut 15 by socket 36*a* may be closely precalculated by taking into consideration design criteria, such as the effective area of the underside of piston head 27*a*, the effective area of the top side of piston head 61, the helix angle of the splines of helical spline connection 66, and the coefficients of friction of helical spline connection 66 and straight spline connection 64, the latter spline connection primarily serving as a reaction member upon rotation of socket 36*a***.

It should be noted that helical spline connection 66 must be of opposite hand relative to the threads of nut 15. As shown in FIG. 4, a clearance "c" is provided between a lower end of piston 63 and the upper surface of head 17 at the beginning of the tightening process. Such clearance would prevent piston 63 from bottoming-out on head 17 whereby an inaccurate torquing of nut 15 could result.

When a worker desires to loosen a tightened nut 15, socket **36*a* and piston 63 must be replaced. In particular, the splines at helical spline connection 66 must now have the same hand as the threads of nut 15. After such replacement has been effected, fastening tool 10*a* is mounted on fastener 11 as shown in FIG. 4, and actuating chamber 30*a* is pressurized to move piston 24*a* upwardly and piston 63 downwardly. Stud 13 will be stretched by piston 24*a* and nut 15 will be loosened from threads 14 of stud 13 whereafter the tool can be removed. This procedure eliminates the need to overstretch stud 13**, as is done in many prior art procedures of this type.

From the above description, it can be seen that the fastening tool embodying this invention provides for the precise and simultaneous imposition of a predetermined tension on fastener 11 and a torquing-down of nut 15 thereof to retain such tension. The tool provides for a smearing or removal of any irregularities or burrs in the interengaging threads of stud 13 and nut 15, as well as those that might be present between the contacting surfaces of nut 15 and the top surface of head 17. The tension that is imposed on fastener 11 will not be prone to substantial decay over a long period of service time in contrast to many fasteners which are secured pursuant to conventional tools and methods.

Other aspects, objects and advantages of this invention can be obtained from a study of the drawings, the disclosure and the appended claims.

I claim:

1. A fastening tool (**10,10*a*) comprising tensioning means (23,23*a*) for detachably engaging an end of a stud (13) and for imposing a predetermined tension (12) thereon, rotating means (35,35*a*) for detachably engaging and rotating a nut (15) threadably mounted on said stud (13) to at least substantially retain said predetermined tension (12) on said stud (13), and fluid control means (31) common to each of said tensioning means (23,23*a*) and said rotating means (35,35*a*) for at least substantially simultaneously imposing said predetermined tension (12) on said stud (13) and for rotating said nut (15**) in response to fluid pressure.

2. The fastening tool of claim 1 wherein said tensioning means (23,23*a*) includes a piston (24,24*a*) reciprocally mounted in said housing (18,18*a*) and wherein said control means (31) includes an actuating chamber (30,30*a*) defined in part by said piston (24,24*a*).

3. The fastening tool of claim 2 wherein said piston (24,24*a*) includes thread means (25,25*a*) for threadably attaching said piston (24,24*a*) to an end of said stud (13).

4. The fastening tool of claim 2 wherein said rotating means (35,35*a*) includes socket means (36,36*a*) for engaging and rotating said nut (15) in response to the selective actuation of said control means (31).

5. The fastening tool of claim 4 wherein said rotating means (35) further includes fluid motor means (45) for rotating said socket means (36,36*a*) in response to pressurization of said actuating chamber (30).

6. The fastening tool of claim 5 wherein said fluid motor means (45) includes a first vane (48) secured within said housing (18) and a second vane (49) secured on said socket means (36) to define a pair of isolated first (52) and second (53) chambers between said first (48) and second (49) vanes and first (46) and second (54) passages defined in said housing (18) intercommunicating said actuating chamber (30) with said first (52) and second (53) chambers, respectively.

7. The fastening tool of claim 6 further including first (55) and second (56) valve means for selectively opening or closing said first (46) and second (54) passages, respectively.

8. The fastening tool of claim 7 further including second (59) and third (60) valve means for selectively venting said first (52) and second (53) chambers, respectively.

9. The fastening tool of claim 4 wherein said rotating means (35*a*) further includes a second piston (63) reciprocally mounted in said housing (18*a*) and disposed radially between said housing (18*a*) and said first-mentioned piston (24*a*) and means (66) connecting said second piston (63) to said socket means (36*a*) for rotating said socket means (36*a*) in response to pressurization of said actuating chamber (30*a*).

10. The fastening tool of claim 9 wherein said means (66) connecting said second piston (63) to said socket means (36*a*) includes a helical spline connection (66) between said second piston (63) and said socket means (36*a*).

11. The fastening tool of claim 10 further including spline connection means (64) between said housing (18*a*) and said second piston (63) for guiding reciprocal movements of said second piston (63) in response to pressurization of said actuating chamber (30*a*).

12. The fastening tool of claim 1 wherein said housing (18,18*a*) is tubular and roughened surface means (22,22*a*) for preventing rotation of said housing (18,18*a*) relative to a member (17) engaged therewith upon actuation of said rotating means (35,35*a*).

13. A fastening tool comprising first means (23,23*a*) for placing a predetermined tension (12) on a first part of a fastener (11), second means (35,35*a*) for at least substantially simultaneously rotating a second part of said fastener (11) to maintain said predetermined tension (12) on said fastener (11), and fluid control means (31) common to each of said first means (23,23*a*) and said second means (35,35*a*) for at least substantially simultaneously imposing said predetermined tension (12) on the first part (13) of said fastener (11) and for rotating the second part (15) thereof in response to fluid pressure.

14. The fastening tool of claim 13 wherein said first means (23,23*a*) includes a piston (24,24*a*) reciprocally mounted in a housing (18,18*a*) and wherein said control means (31) includes an actuating chamber (30,30*a*) defined in part by said piston (24,24*a*).

15. The fastening tool of claim 14 wherein said piston (24,24*a*) includes thread means (25,25*a*) for threadably attaching said piston (24,24*a*) to an end of the first part (13) of said fastener (11).

16. The fastening tool of claim 14 wherein said second means (35,35*a*) includes socket means (36,36*a*) for engaging and rotating the second part (15) of said fastener (11) in response to the selective actuation of said control means (31).

17. The fastening tool of claim 16 wherein said second means (35) further includes fluid motor means (45) for rotating said socket means (36,36*a*) in response to pressurization of said actuating chamber (30).

18. The fastening tool of claim 17 wherein said fluid motor means (45) includes a first vane (48) secured within said housing (18) and a second vane (49) secured on said socket means (36) to define a pair of isolated first (52) and second (53) chambers between said first (48) and second (49) vanes and first (46) and second (54) passages defined in said housing (18) intercommunicating said actuating chamber (30) with said first (52) and second (53) chambers, respectively.

19. The fastening tool of claim 18 further including first (55) and second (56) valve means for selectively opening or closing said first (46) and second (54) passages, respectively.

20. The fastening tool of claim 19 further including second (59) and third (60) valve means for selectively venting said first (52) and second (53) chambers, respectively.

21. The fastening tool of claim 16 wherein said second means (35*a*) further includes a second piston (63) reciprocally mounted in said housing (18*a*) and disposed radially between said housing (18*a*) and said first-mentioned piston (24*a*) and means (66) connecting said second piston (63) to said socket means (36*a*) for rotating said socket means (36*a*) in response to pressurization of said actuating chamber (30*a*).

22. The fastening tool of claim 21 wherein said means (66) connecting said second piston (63) to said socket means (36*a*) includes a helical spline connection (66) between said second piston (63) and said socket means (36*a*).

23. The fastening tool of claim 22 further including spline connection means (64) between said housing (18*a*) and said second piston (63) for guiding reciprocal movements of said second piston (63) in response to pressurization of said actuating chamber (30*a*).

24. The fastening tool of claim 13 further including a housing (18,18*a*) having said first means (23,23*a*) and said second means (35,35*a*) mounted therein and roughened surface means (22,22*a*) on said housing (18,18*a*) for preventing rotation of said housing (18,18*a*) relative to a member (17) engaged therewith upon actuation of said second means (35,35*a*).

* * * * *